US005727525A

United States Patent [19]

Tsuzuki

[11] Patent Number: 5,727,525

[45] Date of Patent: Mar. 17, 1998

[54] ACCUMULATOR FUEL INJECTION SYSTEM

[75] Inventor: Yoshihiro Tsuzuki, Handa, Japan

[73] Assignee: Nippon Soken, Inc., Nishio, Japan

[21] Appl. No.: 724,832

[22] Filed: Oct. 3, 1996

[30] Foreign Application Priority Data

Oct. 3, 1995 [JP] Japan ..... 7-256181
Dec. 21, 1995 [JP] Japan ..... 7-333275

[51] Int. Cl.[6] ..... F02M 51/00

[52] U.S. Cl. ..... 123/447; 123/456; 123/458

[58] Field of Search ..... 123/447, 456, 123/467, 457, 459, 460, 506; 251/129.07

[56] References Cited

U.S. PATENT DOCUMENTS

| | | | |
|---|---|---|---|
| 4,280,464 | 7/1981 | Kanai et al. | 123/447 |
| 4,440,134 | 4/1984 | Nakao et al. | 123/447 |
| 4,643,227 | 2/1987 | Suzuki et al. | 251/129.07 |
| 4,777,921 | 10/1988 | Miyaki et al. | 123/456 |
| 4,832,312 | 5/1989 | Linder et al. | 251/129.07 |
| 4,909,440 | 3/1990 | Mitsuyasu | 251/129.07 |
| 5,035,223 | 7/1991 | Watanabe | 123/459 |
| 5,146,894 | 9/1992 | Rembold et al. | 123/447 |
| 5,176,120 | 1/1993 | Takahashi | 123/447 |
| 5,207,203 | 5/1993 | Wagner et al. | 123/456 |
| 5,313,924 | 5/1994 | Regueiro | 123/456 |
| 5,363,824 | 11/1994 | Bonse | 123/506 |
| 5,456,233 | 10/1995 | Felhofer | 123/447 |
| 5,564,394 | 10/1996 | Wood | 251/129.07 |

FOREIGN PATENT DOCUMENTS

| | | |
|---|---|---|
| 62-258160 | 11/1987 | Japan . |
| 2-191865 | 7/1990 | Japan . |

*Primary Examiner*—Thomas N. Moulis
*Attorney, Agent, or Firm*—Cushman Darby & Cushman IP Group of Pillsbury Madison & Sutro LLP

[57] ABSTRACT

An accumulator fuel injection system for automotive vehicles is provided which includes an accumulating chamber storing therein fuel under a given pressure, a plurality of fuel injectors communicating with the accumulating chamber for injecting the fuel stored therein into engine cylinders of an engine, and a pressure regulator for regulating the pressure of fuel flowing through a drain passage from the accumulating chamber to a fuel tank. When a throttle valve is fully closed during a high-load engine operation, the fuel regulator opens the drain passage to decrease the pressure of fuel within the accumulating chamber to a target pressure level speedily. This allows an actual fuel injection pressure to follow a change in the target pressure level quickly according to an engine operating condition when the throttle valve is reopened.

19 Claims, 8 Drawing Sheets

ACCUMULATOR FUEL INJECTION SYSTEM

BACKGROUND OF THE INVENTION

1. Technical Field

The present invention relates generally to an accumulator fuel injection system for automotive vehicles, and more particularly to an accumulator fuel injection system designed to inject fuel stored within an accumulator into engine cylinders through fuel injectors at an optimum pressure under various engine operating conditions.

2. Background of Related Art

Japanese Patent First Publication No. 62-258160 teaches a conventional accumulator fuel injection system which injects fuel into engine cylinders through fuel injectors and then supplies additional fuel through a variable capacity pump to a common rail provided as an accumulator by the amount of fuel consumed in the engine.

FIG. 1 shows a structure of the above accumulator fuel injection system.

The engine 51 has injectors 52 installed in combustion chambers of engine cylinders one in each. Fuel injection from the injectors 52 into the engine 51 is controlled by on-off operations of injection control solenoid valves 53. The injectors 52 are connected to a high-pressure accumulator pipe or so-called common rail 54 communicating with each engine cylinder. During a time when the solenoid valve 53 is opened, fuel within the common rail 54 is injected into the engine 51 through the injectors 52. It is thus necessary to store within the common rail 54 at all times fuel under a high pressure corresponding to an actual fuel injection pressure. For this, a high-pressure supply pump 57 is provided which connects with a supply pipe 55 through a check valve 56.

The high-pressure supply pump 57 elevates the pressure of fuel which is sucked from a fuel tank 58 through a known lower-pressure supply pump 59 to a high level required by the system and keeps the fuel at that level. In order to maintain the pressure in the common rail 54 at a given high level, the following two methods may be proposed.

(1) A constant amount of fuel is supplied to the common rail all the time using a pump having a sufficient capacity, and an excess of the fuel supplied to the common rail is discharged from a relief valve.

(2) Fuel of an amount required for maintaining the pressure in the common rail constant is supplied to the common rail at all times. Specifically, a pump discharge quantity control device is provided which is controllable according to commands issued from an external device.

The proposal (2) is clearly superior to the proposal (1) for the loss of drive torque of the supply pump. Therefore, in the shown conventional system, a pump discharge quantity control device 60 is provided in the pump 57 which has a spill valve for maintaining the pressure in the common rail constant at all times.

An electronic control unit (ECU) 61 receives information signals indicating engine speed and engine load monitored by an engine speed sensor 62 and a load sensor 63 to provide control signals to the solenoid valves 53 for establishing optimum fuel injection timing and fuel injection amount (i.e., injection period) according to operational conditions of the engine and at the same time to provide a control signal to the pump discharge quantity control device 60 so as to optimize the injection pressure according to the engine speed and engine load.

A pressure sensor 64 measuring a common rail pressure is arranged in the common rail 54. The pump discharge quantity control device 60 controls the discharge quantity of the supply pump 57 so that a signal from the pressure sensor 64 shows an optimum level determined based on the engine speed and engine load. Specifically, more precise pressure adjustment is achieved by performing negative feedback control of the pressure in the common rail.

FIGS. 2(*a*) to 2(*d*) are timing charts of common rail pressure control performed by the above fuel injection system.

A constant mount of fuel (corresponding to the amount of fuel consumed in fuel injection and hydraulic servo-control of the injectors), as indicated by a hatched area in FIG. 2(*a*), accumulated within the common rail 54 under a pressure of, for example, 100 MPa is consumed each time a control pulse signal is provided to each of the injectors 52. The high-pressure supply pump 57 supplies to the common rail 54 a required amount of fuel, as indicated by a hatched area in FIG. 2(*d*), only equivalent to the amount of fuel consumed. This required amount of fuel usually changes according to the fuel injection amount and engine speed, and the pump discharge quantity control device 60 controls this amount in the following manner. For example, when the fuel injection amount is considerably small, the discharge quantity of the supply pump 57 may be small. Conversely, when it is required to inject a maximum amount of fuel into the engine, the supply pump 57 needs to discharge a large amount of fuel. The more precise pressure control, as discussed above, is achieved by monitoring the pressure in the common rail 54 at all times through the pressure sensor 64 and by controlling the discharge quantity of the supply pump 57 so the pressure in the common rail 54 reaches a given level according to the engine speed and engine load.

In order to supply, keep, and control the above high-pressure fuel, it is effective to supply the fuel each operation cycle of the fuel injection system or in synchronization with each fuel injection operation. This may be accomplished with the use of an intermittent reciprocation type jerk pump as the high-pressure pump 57 which is designed, like a conventional vertical injection pump, to provide pressurized fuel each combustion cycle of the engine.

In the above conventional fuel injection system wherein the variable capacity pump (i.e., the high-pressure supply pump 57) supplies to the common rail 54 only the amount of fuel equivalent to the amount of fuel injected into the engine through the injectors, a constant supply of fuel, as indicated by the hatched areas in FIG. 2(*d*), corresponding to the amount of fuel consumed in the engine when the engine operation is switched from a low-load condition to a high-load condition is easily achieved by increasing the discharge quantity of the high-pressure pump 57. However, when an accelerator pedal is released completely to decelerate a vehicle suddenly during high-load engine operations, it will cause the pressure in the common rail 54 to be slightly decreased only by a small leakage of fuel even if the supply of fuel from the high-pressure pump 57 is stopped. The pressure in the common rail 54 is thus substantially maintained at a high level. Subsequently, when the accelerator pedal is depressed slightly to operate the engine at a low load, an actual pressure level in the common rail 54 is much higher than a target level, thereby resulting in uncomfortable acceleration shock generated when the engine is accelerated again, deterioration in emission, and increase in mechanical noise.

FIG. 3 shows another conventional accumulator fuel injection system using a three-port directional control valve.

The shown accumulator fuel injection system includes a three-port directional control valve 72 and a valve control circuit 75. When the pressure of fuel within an accumulator pipe 71 is greater than a target controlled pressure, the valve control circuit 75 switches a valve position of the directional control valve 72 to establish fluid communication between the accumulator pipe 71 and a low-pressure section (i.e., a drain) of a fuel system through a fluid passage 74 for a short period of time, thereby discharging part of high-pressure fuel stored within the accumulator pipe 71 to the low-pressure section of the fuel system for decreasing the pressure in the accumulator pipe 71 quickly. This allows the pressure of fuel within the accumulator pipe 71 to follow a target controlled pressure quickly even after a fuel injector 73 is closed, for example, during a fuel cut.

Additionally, when the pressure of fuel in the accumulator pressure is greater than the target controlled pipe 71, a drop in pressure in the accumulator pipe 71 may be accomplished by turning on and off the directional control valve 72 cyclically at time intervals shorter than a lag time between the switching of the directional control valve 72 and the resumption of fuel injection of the injector 73 to establish fluid communication between a high-pressure side and a low-pressure side intermittently. Such control of the directional control valve 72 is applicable only to a three-port valve and is generally called switching leak which is known as a useful technique for lowering the fuel pressure at a high-pressure side.

In recent years, there is an increasing demand for compact fuel injection pumps used in small-sized diesel engines. A two-port directional control valve in an accumulator fuel injection system is required in place of a three-port directional control valve for the purpose of decreasing the capacity of a pump. The use of the two-port directional control valve however precludes the switching leak that establishes fluid communication between a high-pressure side and a low-pressure side as in the system using the three-port directional control valve. Thus, even if the fuel supply from a fuel injection pump is stopped during a time when fuel is not injected into the engine such as a fuel cut, it is impossible to decrease the pressure in a large capacity accumulator chamber, such as a common rail, quickly. The system thus needs to wait for a gentle drop in pressure in the accumulator chamber caused by a small fuel leakage from sliding portions of the pump and the valve.

Accordingly, the use of the two-port directional control valve usually reduces the system response, thereby causing uncomfortable acceleration shock, deterioration in emission, and mechanical noise.

SUMMARY OF THE INVENTION

It is therefore a principal object of the present invention to avoid the disadvantages of the prior art.

It is another object of the present invention to provide a fuel injection system designed to avoid the above described acceleration shock, deterioration in emission, and mechanical noise which would be produced when an engine re-accelerates under a low-load condition following sudden deceleration during a high-load engine operation.

According to one aspect of the present invention, there is provided an accumulator fuel injection apparatus which comprises: (a) a first accumulating chamber storing therein fuel under a first pressure; (b) a fuel injector communicating with the first accumulating chamber; (c) a control circuit providing a control signal to the fuel injector to inject part of the fuel stored within the first accumulating chamber into an engine; (d) a second accumulating chamber; (e) a drain passage communicating the first accumulating chamber with the second accumulating chamber for draining the fuel from the first accumulating chamber to the second accumulating chamber; (f) a valve means for selectively establishing and blocking communication between the first accumulating chamber and the second accumulating chamber; and (g) a pressure regulating means for regulating the pressure of the fuel stored within the second accumulating chamber to a second pressure smaller than the first pressure.

In the preferred mode of the invention, when a throttle valve opening degree is changed to substantially zero during a high-load engine operation, the control circuit provides a control signal to the valve means to establish communication between the first accumulating chamber and the second accumulating chamber.

According to another aspect of the invention, there is provided an accumulator fuel injection apparatus which comprises: (a) an accumulating chamber storing therein fuel under a first pressure; (b) a plurality of fuel injectors communicating with the accumulating chamber for injecting the fuel within the accumulator into engine cylinders of an engine; (c) a drain passage for draining the fuel stored within the accumulator; and (d) a pressure regulating means for regulating the pressure of the fuel drained through the drain passage to a second pressure lower than the first pressure.

According to a further aspect of the invention, there is provided an accumulator fuel injection apparatus which comprises: (a) an accumulating chamber storing therein fuel under a first pressure; (b) a plurality of fuel injectors communicating with the accumulating chamber for injecting the fuel within the accumulator into engine cylinders of an engine; (c) a first means for determining whether a given pressure dropping condition for dropping the pressure of the fuel stored within the accumulator is met or not, when the given pressure dropping condition is met, the first means providing a release signal; (d) a second means, responsive to the release signal from the first means, for draining the fuel stored within the accumulator while regulating the pressure thereof a second pressure lower than the first pressure.

In the preferred mode of the invention, the first means includes engine speed determining means for determining an engine speed, throttle valve opening degree determining means for determining an opening degree of a throttle valve, and deceleration determining means for determining whether or not a given engine operating condition such that the engine decelerates at a given rate when the opening degree of the throttle valve is smaller than a preselected value, is met based on the engine speed and the opening degree of the throttle valve determined by the engine speed determining means and the throttle valve opening degree determining means, and when the given engine operating condition is met, the deceleration determining means providing the release signal to the second means.

A drain passage is further provided which drains the fuel stored within the accumulating chamber. The second means includes a solenoid valve disposed within the drain passage and a second accumulating chamber connected to the solenoid valve.

The solenoid valve includes a control port having formed thereon a valve seat, a valve selectively brought into engagement with and disengagement from the valve seat of the control port to open and close the drain passage, a valve spring urging the valve into engagement with the valve seat of the control port, a solenoid moving the valve out of engagement with the valve seat of the control port when the solenoid is turned on, a cylinder formed in the valve having a diameter smaller than that of the valve seat of the control port, a balance rod slidably disposed within the cylinder in liquid-tight relationship with the cylinder, a balance pressure chamber defined within the cylinder by the balance rod, and a passage formed in the valve communicating between the control port and the balance pressure chamber at all times.

A spring force of the valve spring is set so that a hydraulic force produced when the fuel is stored within the accumulating chamber under a maximum pressure urges the valve out of engagement with the valve seat against the spring force of the valve spring.

An attracting force of the solenoid moving the valve out of engagement with the valve seat is so set as to balance with the sum of a hydraulic force acting on the valve when the fuel is stored in the accumulating chamber under a minimum pressure within a given normal range and a spring force of the valve spring.

An orifice is further disposed between the accumulating chamber and the valve seat of the control port.

According to a further aspect of the invention, there is provided a pressure control apparatus for use in an accumulator fuel injection apparatus including an accumulating chamber storing therein fuel under a given pressure and an electrically controlled fuel injector for injecting the fuel in the accumulating chamber into an engine cylinder, which comprises: (a) a control port having formed thereon a valve seat, communicating with the accumulating chamber through a drain passage for draining the fuel within the accumulating chamber; (b) a valve selectively brought into engagement with and disengagement from the valve seat of the control port to open and close the drain passage; (c) a valve spring urging the valve into engagement with the valve seat of the control port; (d) a solenoid moving the valve out of engagement with the valve seat of the control port when the solenoid is turned on; (e) a cylinder formed in the valve having a diameter smaller than that of the valve seat of the control port; (f) a balance rod slidably disposed within the cylinder in liquid-tight relationship therewith; (g) a balance pressure chamber defined within the cylinder by the balance rod; and (h) a passage formed in the valve communicating between the control port and the balance pressure chamber at all times.

In the preferred mode, a spring force of the valve spring is set so that a hydraulic force produced when the fuel is stored within the accumulating chamber under a maximum pressure urges the valve out of the engagement with the valve seat against the spring force of the valve spring.

An attracting force of the solenoid moving the valve out of engagement with the valve seat is so set as to balance with the sum of a hydraulic force acting on the valve when the fuel is stored in the accumulating chamber under a minimum pressure within a given normal range and a spring force of the valve spring.

An orifice is further provided which communicates between the accumulating chamber and the valve seat of the control port.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 4:
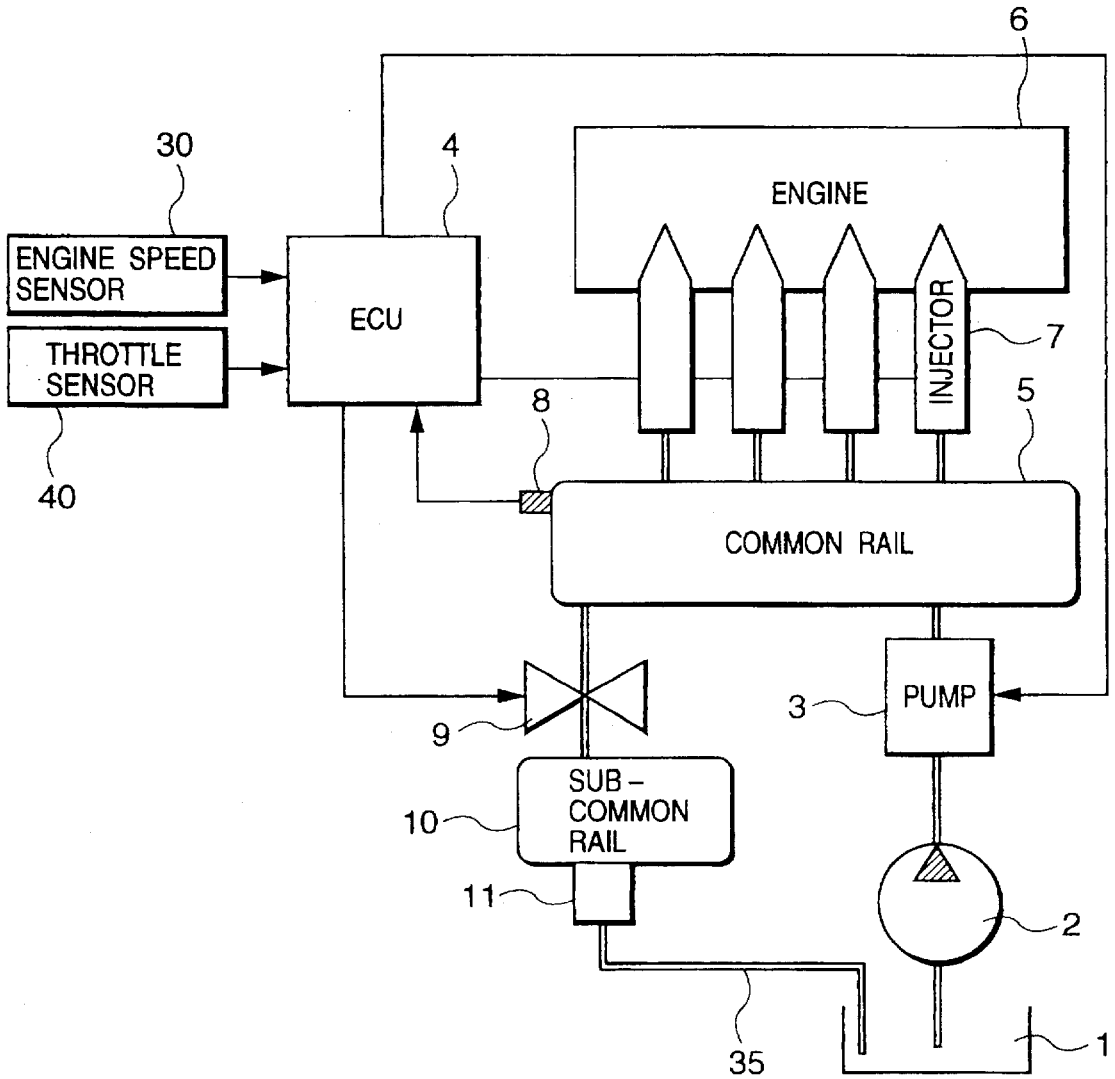
FIG. 4 is a block diagram which shows an accumulator fuel injection system according to the present invention.

Referring now to the drawings, particularly to FIG. 4, there is shown an accumulator fuel injection system according to the present invention which is used with a four-cylinder engine as one example.

The fuel injection system includes generally a low-pressure pump 2, a high-pressure pump 3, an electronic control unit (ECU) 4, a first accumulating chamber 5 (hereinafter, referred to as a common rail), a pressure sensor 8, a solenoid valve 9, a second accumulating chamber (hereinafter, referred to as a sub-common rail) 10, and a pressure regulator 11.

The low-pressure pump 2 sucks in fuel stored within a fuel tank 1 to supply it to the high-pressure pump 3. The high-pressure pump 3 elevates the pressure of the fuel to a given required level, supplies it to the common rail 5, and maintains a constant pressure in the common rail 5 under control of the ECU 4. Injectors 7 are provided, one for each engine cylinder of an engine 6, for injecting high-pressure fuel stored within the common rail 5 into the engine cylinders in response to control signals issued from the ECU 4. The pressure sensor 8 monitors the pressure in the common rail 5 to provide a signal indicative thereof to the ECU 4.

The common rail 5 communicates with the fuel tank 1 through a drain passage 35. The solenoid valve 9 is responsive to a control signal from the ECU 4 to selectively establish and block communication between the common rail 5 and the sub-common rail 10 for draining the high-pressure fuel accumulated within the common rail 5 to the sub-common rail 10. The pressure in the sub-common rail 10 is regulated by the pressure regulator 11 to a preselected level, for example, approximately 12 MPa which is a minimum injection pressure of a typical engine. The pressure regulator 11 can be of a mechanical regulator or a solenoid valve. 15 The solenoid valve 9 is normally closed to block communication between the common rail 5 and the sub-common rail 10.

Hereinbelow, the pressure regulator 11 connected to the sub-common rail 10, that is one of features of the present invention, will be discussed.

Considering the case where the pressure regulator 11 is not provided, the high-pressure fuel introduced into the sub-common rail 10 from the common rail 5 through the solenoid valve 9 is discharged directly to the fuel tank 1. When the pressure of this fuel is decreased quickly to about an atmospheric pressure, the fuel generates a large amount of heat caused by a difference in pressure, thereby elevating the temperature in the fuel tank 1. Further, when the solenoid valve 9 malfunctions while it is opened to cause the common rail 5 to communicate with the fuel tank 1, it will cause the common rail 5 to remain exposed to the atmosphere. Thus, it becomes impossible to elevate the pressure in the common rail 5, causing the whole system to be deactivated. For these reasons, in the fuel injection system of this embodiment, the pressure regulator 11 is disposed at the sub-common rail 10 for preventing the common rail 5 from communicating directly with the atmosphere through the solenoid valve 9 to return the fuel to the fuel tank 1 through the sub-common rail 10, in which the pressure is set to, for example, about 12 MPa, which is a minimum fuel injection pressure of a typical engine. With these arrangements, the fuel injection system maintains at least the minimum fuel injection pressure even if a failure in an operation of the solenoid valve 9 occurs. This prevents the whole system from malfunctioning suddenly. Additionally, since the high-pressure fuel is not decreased directly to the atmospheric pressure, the above described heat caused by the difference in pressure is small as compared with the system not including the sub-common rail 10.

The ECU 4 receives sensor signals indicative of engine speed and an opening degree of a throttle valve (i.e., the degree of acceleration) monitored by an engine speed sensor 30 and a throttle sensor 40 to determine an engine operating condition and determines optimum fuel injection timing and fuel injection amount based on the determined engine operating condition to provide control signals for controlling on-off operations of the injectors 7. Simultaneously, the ECU 4 is responsive to a sensor signal from the pressure sensor 8 to provide a control signal to the high-pressure pump 3. The high-pressure pump 3 then elevates the pressure of fuel to be supplied to the common rail 5 to a given level required by the system and maintains it at that level. The ECU 4 also determines whether or not the throttle valve is fully closed during a high-load (high-pressure) engine operation to decelerate the vehicle suddenly based on the sensor signals from the engine speed sensor 30 and the throttle sensor 40. If such a condition is encountered, the ECU 4 provides a control signal to the solenoid valve 9 to open it for discharging the high-pressure fuel stored in the common rail 5 to the sub-common rail 10 so as to decrease the pressure in the common rail 5 down to an actual fuel injection pressure (i.e., a target level).

An operation of the fuel injection system of this embodiment will be described below with reference to timing charts of FIGS. 5(*a*) to 5(*d*).

Figures 5A, 5B, 5C, 5D:
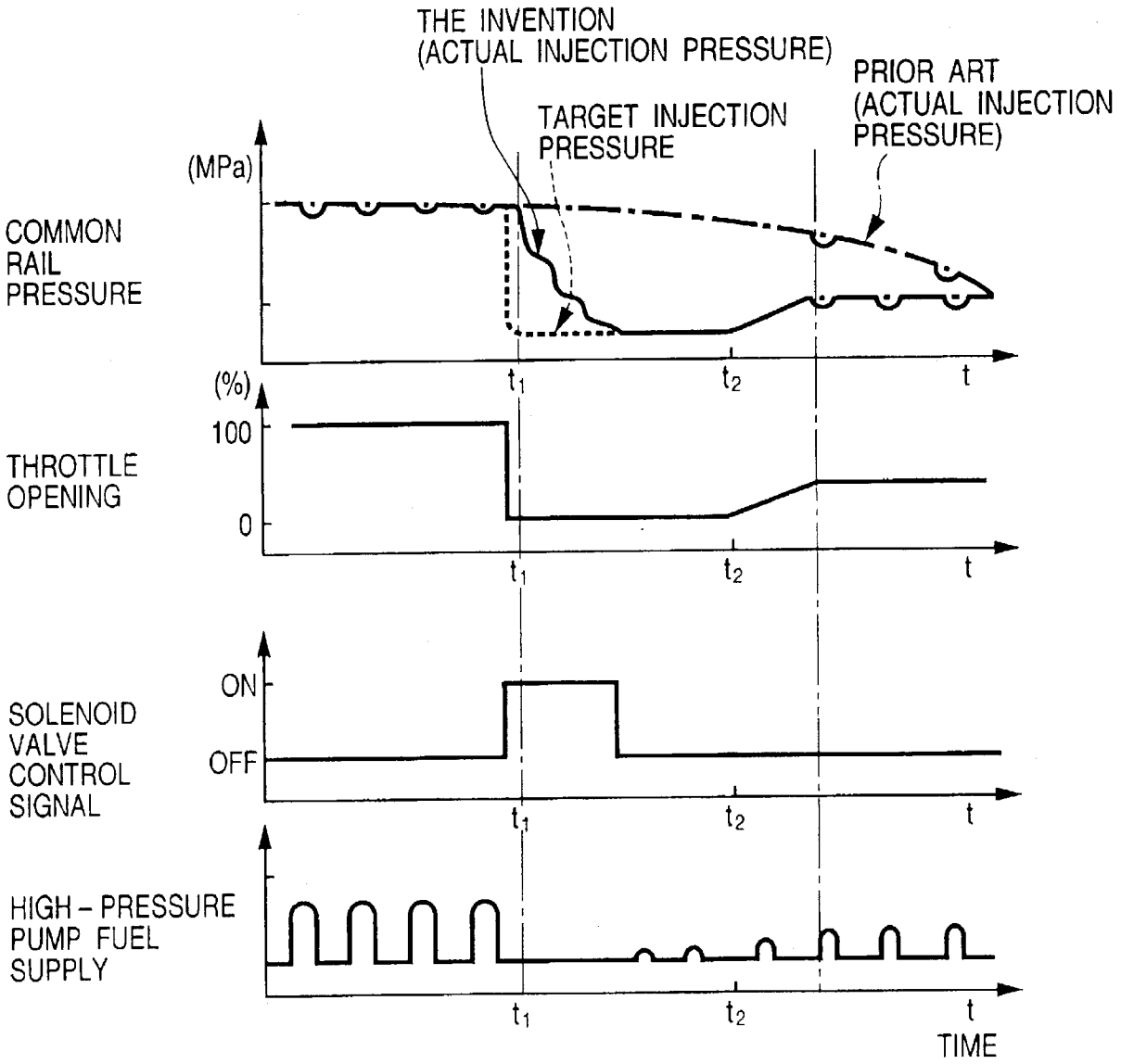
FIG. 5(*a*) to 5(*d*) are timing charts which show operations of the accumulator fuel injection system as shown in FIG. 4.

FIG. 5(*a*) shows the pressure in the common rail 5. FIG. 5(*b*) shows the opening degree of the throttle valve. FIG. 5(*c*) shows an on-off control signal provided to the solenoid valve 9. FIG. 5(*d*) shows the amount of fuel discharged from the high-pressure pump 3. In the timing charts, the engine 6 operates under high-load (high-pressure fuel) operating condition until time t1, decelerates with a zero (0) degree of opening of the throttle valve at time tl, and then restarts accelerating under a low-load (low-pressure fuel) operating condition at time 2.

As can be seen from the drawings, when the throttle valve is fully closed during the high-load engine operation to decelerate the engine 6 at time tl, the ECU 4 deactivates the high-pressure pump 3 to stop the supply of fuel to the common rail 5. The common rail pressure in the conventional system is, however, decreased slightly, as shown by a chain line in FIG. 5(*a*), only due to the above discussed small fuel leakage. Thus, at time 12 when the low-load engine operation is started, an actual fuel injection pressure (i.e., a common rail pressure) is much greater than a target pressure level required by the ECU 4. This will give rise to the problems, as discussed in the introductory part of this application.

In the fuel injection system of this embodiment, when the throttle valve is fully closed during the high-load engine operation at time t1, the ECU 4 opens the solenoid valve 9 to establish fluid communication between the common rail 5 and the sub-common rail 10 for returning the high-pressure fuel stored in the common rail 5 to the fuel tank 1, thereby decreasing the common rail pressure (i.e., an actual fuel injection pressure) quickly to the target pressure level. After time 2 when the low-load engine operation is restarted, the actual fuel injection pressure is increased following an increase in target pressure level determined by the ECU 4, thereby allowing the engine operating conditions to be controlled precisely by the ECU 4.

Figure 6:
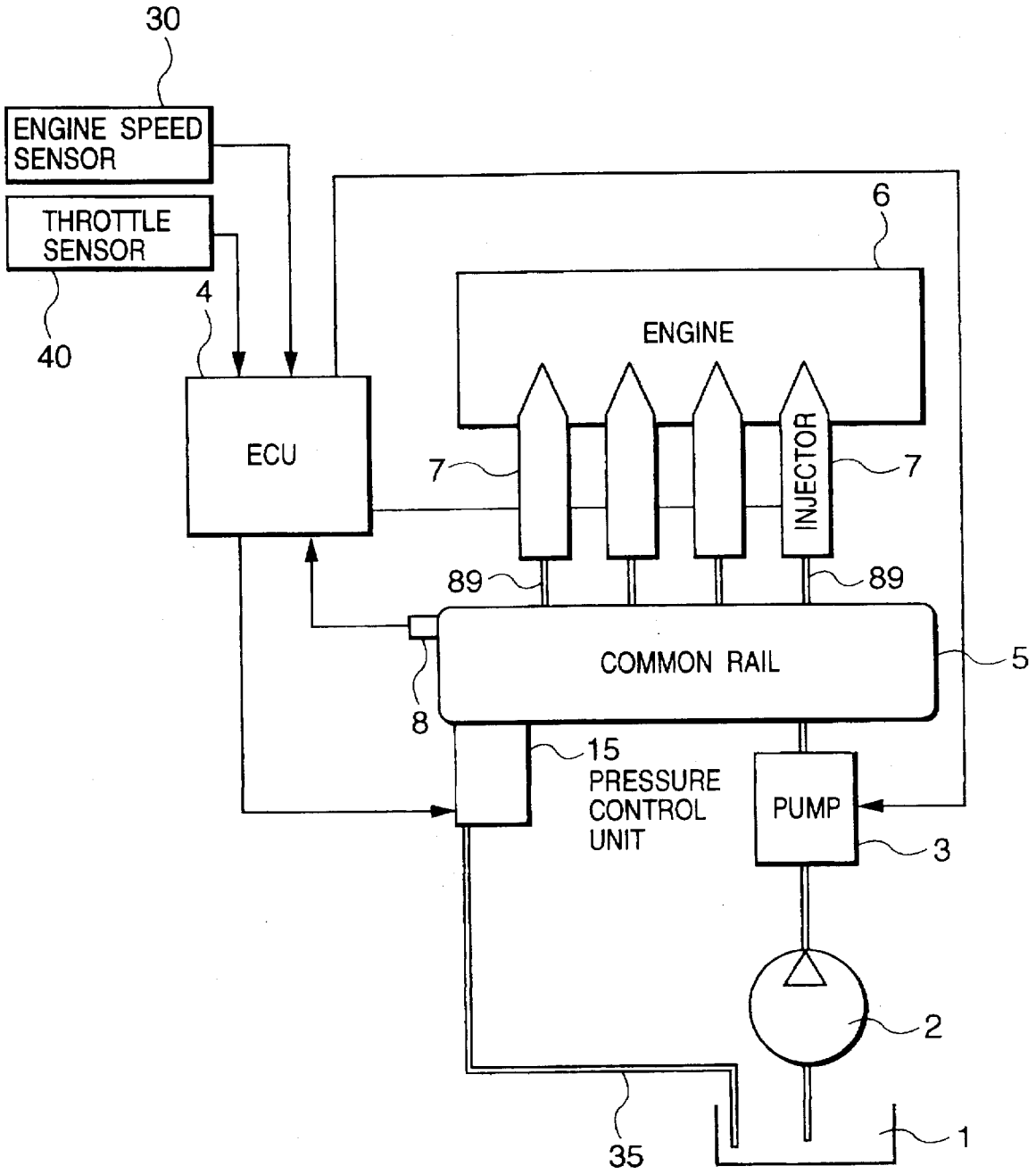
FIG. 6 is a block diagram which shows the second embodiment of an accumulator fuel injection system of the invention.

FIG. 6 shows a second embodiment of the accumulator fuel injection system of this invention which includes a pressure control unit 15 designed to perform substantially the same operation as discussed in the above first embodiment with reference to FIGS. 5(*a*) to 5(*d*). The same reference numbers as employed in the above first embodiment refer to the same parts, and explanation thereof in detail will be omitted here.

The accumulator fuel injection system of this embodiment includes fuel injectors 7 of a two-port type connecting with the common rail 5 through high-pressure passages 89 and a pressure control unit 15 communicating the common rail 5 directly with the fuel tank 1. The pressure control unit 15 operates in response to a control signal provided by the ECU 4 based on a common rail pressure, an engine speed, and an engine load monitored by the pressure sensor 8, the engine speed sensor 30, and the throttle sensor 40. When the common rail pressure is greater than a target pressure level which is determined based on an engine operating condition derived by the engine speed and the engine load, the ECU 4 provides a control signal to the pressure control unit 15 to decrease the common rail pressure to the target pressure level.

Figure 7:
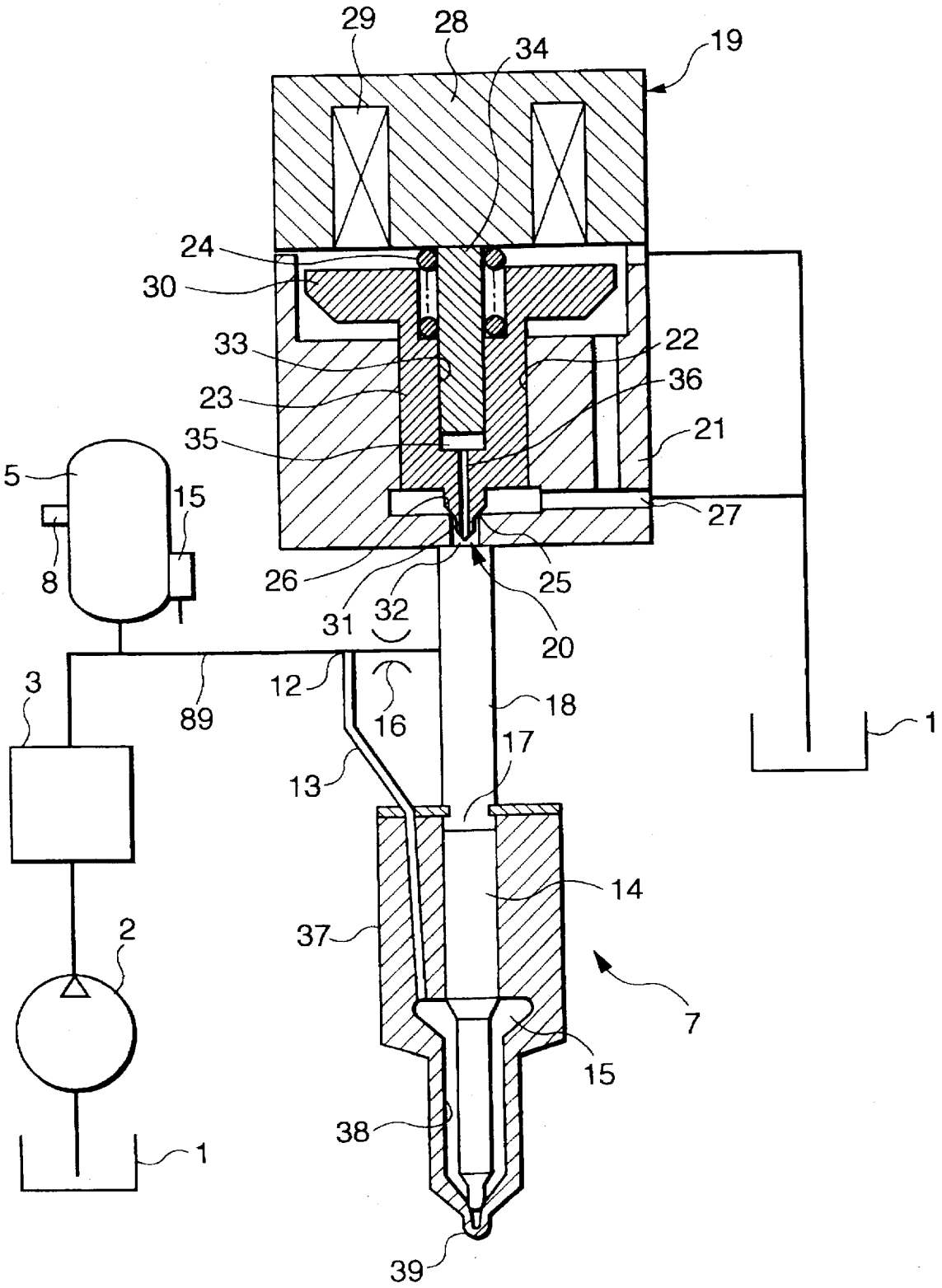
FIG. 7 is a cross sectional view which shows a two-part fuel injector incorporated in the accumulator fuel injection system as shown in FIG. 6.

FIG. 7 shows an internal structure of each of fuel injectors 7 in a cross sectional view. The fuel tank 1 shown does not always need to be a fuel tank under an atmospheric pressure, but may alternatively be a low-pressure portion of a fuel system, such as a drain.

The fuel pressurized by the high-pressure pump 3 is stored within the common rail 5 under a given pressure and is also supplied to the fuel injector 7 through an inlet port 12. Part of the fuel is introduced through a passage 13 into an oil reservoir 15 defined by a valve seat for a needle 14 to develop a hydraulic force urging the needle 14 upward, as viewed in the drawing. When the needle 14 is shifted to a valve opening position, the fuel is, as described later in detail, discharged from a nozzle opening 39.

Part of the fuel stored in the common rail 5 is also supplied to a back pressure chamber 17 through an orifice 16 to create a hydraulic pressure urging the needle 14 downward, as viewed in the drawing. The back pressure chamber 17 communicates with a control port 20 of a two-port hydraulic control valve 19 through a passage 18 at all times. A spring (not shown for the brevity of illustration)

engages the needle 14 for urging the needle 14 downwards to close the nozzle opening 39 regardless of the hydraulic pressure acting on the oil reservoir 15 and the back pressure chamber 17. A command piston may also be provided between the back pressure chamber 17 and the upper end of the needle 14 so that it is moved by the movement of the needle 14.

The hydraulic control valve 19 includes a valve body 21 and a valve 23. The valve 23 is slidably disposed within a valve cylinder 22 formed in the valve body 21 and urged by a valve spring 24 downward to bring a cone-shaped valve head 25 into engagement with a valve seat 26 formed on an upper edge of the control port 20 for blocking fluid communication between the control port 20 (i.e., the back pressure chamber 17) and a drain port 27 formed in the valve body 21. The drain port 27 communicates with the fuel tank 1.

The hydraulic control valve 19 also includes a solenoid 29 made up of wire wound around a magnetic core 28, disposed on the valve body 21. The solenoid 29 is turned on and off in response to a control signal outputted from the ECU 4 through a control circuit (not shown). The valve 23 includes a magnetic armature 30 which is attracted upward when the solenoid 29 is turned on. Specifically, when the solenoid 29 is turned on, the valve 23 is moved upward against a spring force of the spring 24 so that the valve head 25 leaves the valve seat 26 to establish the fluid communication between the control port 20 and the drain port 27.

The valve 23, as clearly shown in the drawing, also includes a cylindrical pin 31 formed on the valve head 25. The pin 31 is inserted into the control port 20 within a given range of movement of the valve 23 so as to define a second orifice 32 between the periphery of the pin 31 and the inner wall of the control port 20.

The valve 23 has formed therein a small-diameter cylinder 33 extending in a lengthwise direction of the valve 23. Within the cylinder 33, a piston-like balance rod 34 is disposed with an upper end engaging a lower surface of the balance pressure and defines a balance pressure chamber 35 according to the vertical movement of the valve 23. The balance pressure chamber 35 communicates with the back pressure chamber 17 through a fine passage 36 extending along the center line of the valve 23.

In operation, when the solenoid 29 is turned off, the valve head 25 of the valve 23 engages the valve seat 26, as shown in FIG. 7, to block the fluid communication between the control port 20 and the drain port 27. The pressure in the common rail 5 thus acts on the back pressure chamber 14 to urge the needle 17 downward with aid of the spring force of the spring (not shown), thereby closing the nozzle opening 39. The fuel stored within the common rail 5 is supplied around the nozzle opening through the inlet port 12, the passage 13, the oil reservoir 15, and the passage 38 defined around the needle 14. When the valve 23 is in a valve closing position, as shown in FIG. 7, the hydraulic pressure in the oil reservoir 15 urging the needle 14 upward is smaller than the sum of the hydraulic pressure in the back pressure chamber 17 and the spring force of the spring (not shown) pushing the needle 14 downward so that the needle 14 continues to close the nozzle opening 39.

When it is required to inject the fuel into the engine 6 through the fuel injector 7, the ECU 4 turns on the solenoid 29 to attract the valve 23 upward for establishing the fluid communication between the control port 20 and the drain port 27. The pressure in the back pressure chamber 17 is then decreased, thereby causing the hydraulic pressure in the oil reservoir 15 urging the needle 14 upward to exceed the sum of the hydraulic pressure in the back pressure chamber 17 and the spring force of the spring (not shown) pushing the needle 14 downward so that the needle 14 is moved upward to open the nozzle opening 39. The fuel reaching near the nozzle opening 39 is then sprayed into the engine 6.

When it is required to stop the fuel supply to the engine 6, the ECU 4 turns off the solenoid 29. This causes the electromagnetic force attracting the armature 30 to disappear so that the valve 23 is urged downward by the spring force of the spring 24 to bring the valve head 25 into engagement with the valve seat 26, thereby blocking the fluid communication between the control port 20 and the drain port 27. The fuel stored within the common rail 5 then flows into the back pressure chamber 17 through the first orifice 16 to elevate the pressure therein up to the same pressure level as in the common rail 5, urging the needle 14 downward with the aid of the spring force of the spring (not shown). When this urging force exceeds a lifting force acting on the needle 14 provided by the fuel pressure in the oil reservoir 15, it will cause the needle 14 to be moved downward to close the nozzle opening 39.

In the above structure of the fuel injection system, at least part of an upward force acting on the control port 20 to move the valve 23 upward, provided by the pressure of the fuel in the back pressure chamber 17 is canceled by a downward force acting on the valve 23, provided by the pressure of the fuel entering the balance pressure chamber 35 through the passage 36. This allows both the spring force of the spring 24 urging the valve 23 to the valve closing position and the electromagnetic force of the solenoid 29 attracting the valve 23 upward against the spring force of the spring 24 to be decreased, resulting in a compact and economical structure of the system.

Figure 1:
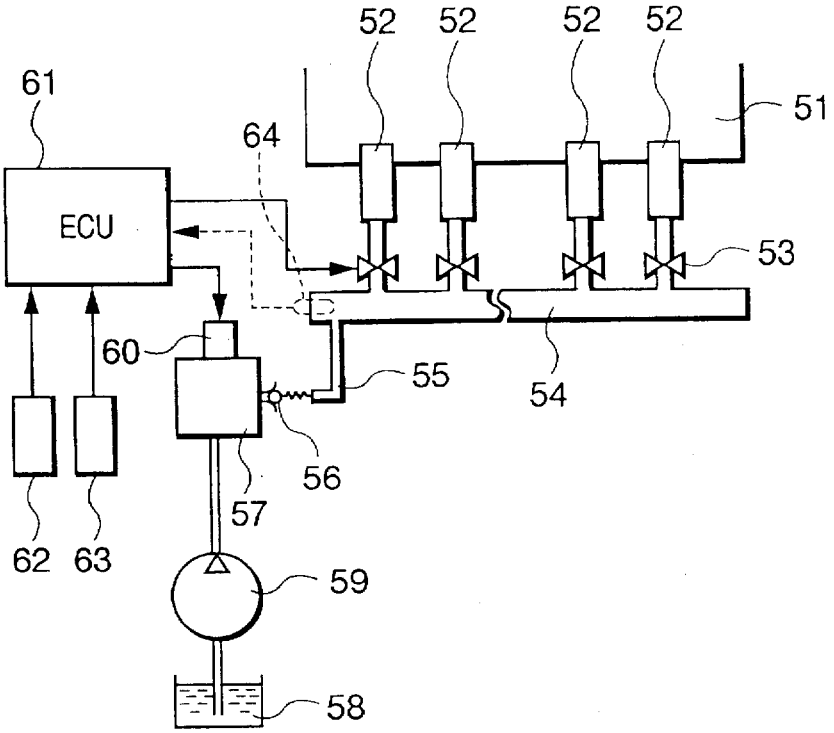
FIG. 1 PRIOR ART
FIG. 1 is a block diagram which shows a conventional accumulator fuel injection system.
Figure 3:
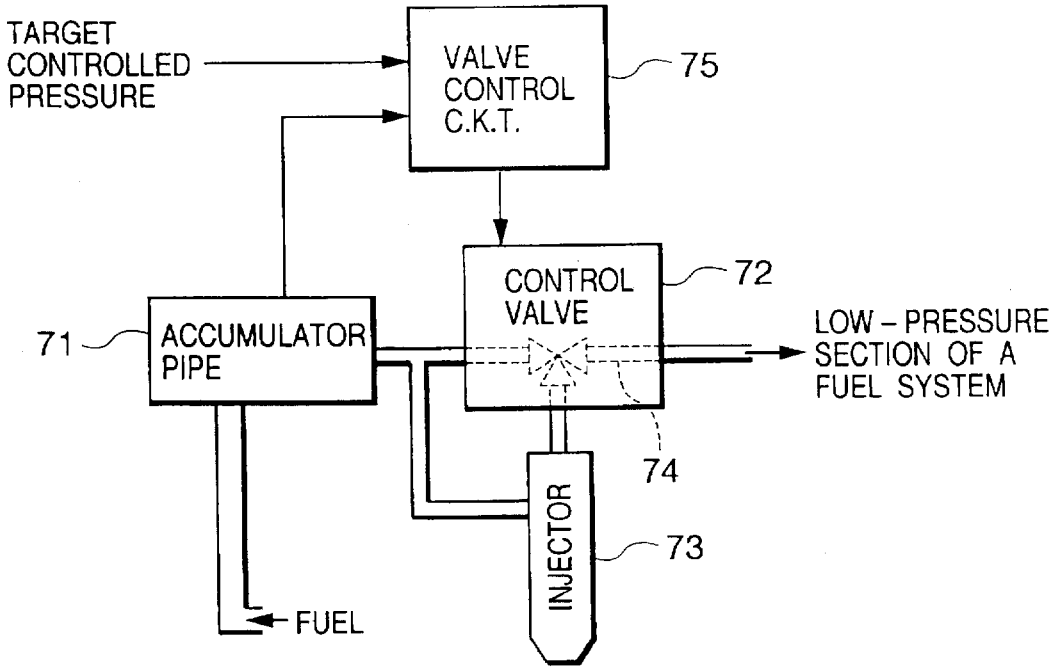
FIG. 3 PRIOR ART
FIG. 3 is a block diagram which shows another type of conventional accumulator fuel injection system.
Figure 2A:
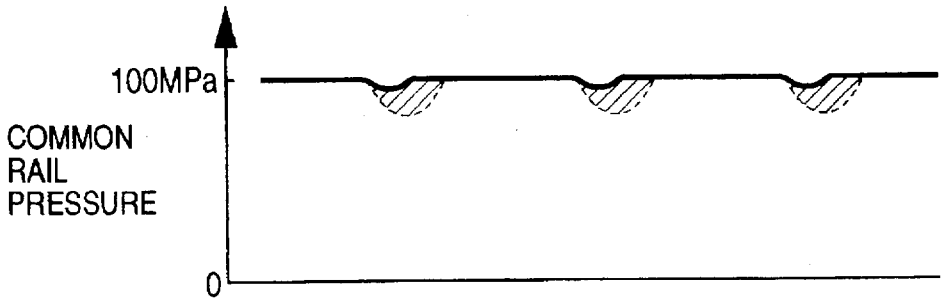
FIGS. 2(*a*) to 2(*d*) are timing charts which show operations of the accumulator fuel injection system as shown in FIG. 1.
Figure 2B:
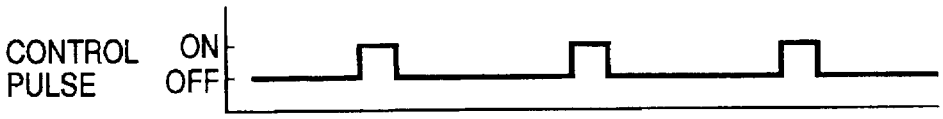
Figure 2C:
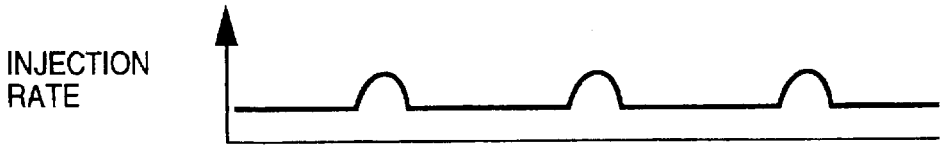
Figure 2D:
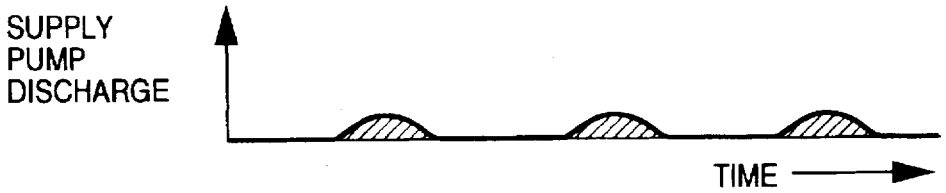

In the above structure of the two-port fuel injector 7, when the hydraulic control valve 19 is opened, the high-pressure fuel entering the inlet port 12 flows to the drain port 27 through the first orifice 16 having a smaller diameter (e.g., 0.2 to 0.3 mm) and the second orifice 32. Specifically, the so-called switching leak communicating a high-pressure side directly with a low-pressure side by the switching operation of the three-port hydraulic control valve 72, as shown in FIG. 3, does not take place in the two-port fuel injector 7. Therefore, when the hydraulic control valve 19 is in the valve closing position, a drop in pressure in the common rail 5 is, as discussed above, caused only by leakage of fuel flowing through any clearances of sliding parts in the absence of discharge of the fuel from the high-pressure pump 3, thus requires a relatively long period of time until the pressure in the common rail 5 reaches a given lower level.

For avoiding the above drawback, the accumulator fuel injection system of this embodiment includes the pressure control unit 15.

Figure 8:
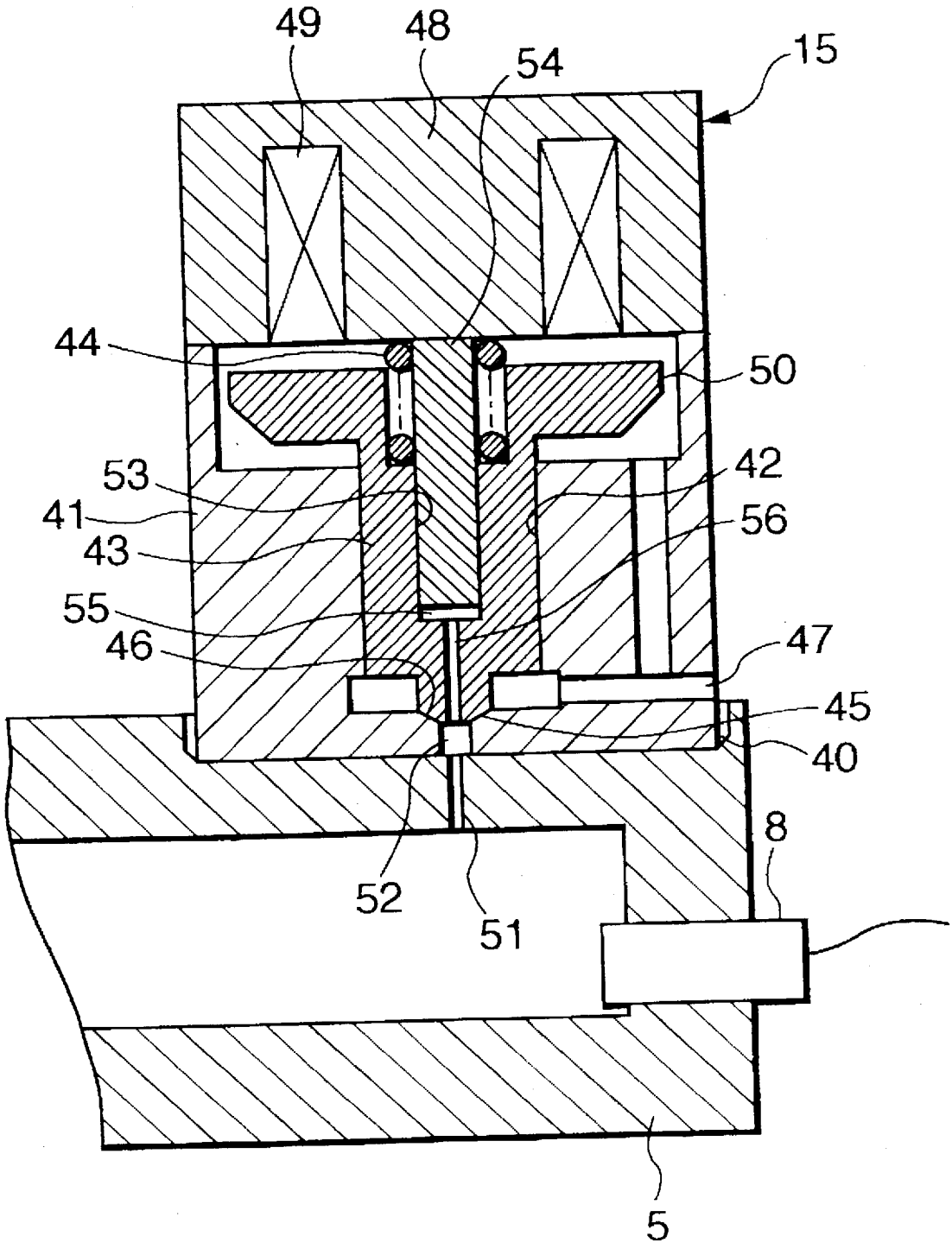
FIG. 8 is a cross sectional view which shows a pressure control valve installed in the accumulator fuel injection system as shown in FIG. 6.

FIG. 8 shows an internal structure of the pressure control unit 15. The pressure control unit 15 has the advantage that it has a similar structure to that of the hydraulic control valve 19 used in the two-part fuel injector 7 and thus may be made up of the same parts as those used in the hydraulic control valve 19.

The pressure control unit 15 is, as clearly shown in the drawing, installed in liquid-tight relationship with the common rail 5 through threads formed on a lower portion of a valve body 41 using a seal member (not shown). The common rail 5 has disposed therein the pressure sensor 8 which measures the pressure therein to provide a signal indicative thereof to the ECU 4.

The pressure control unit 15 includes a valve 43 inserted into a valve cylinder 42 formed in the valve body 41 to be slidable in a vertical direction, as viewed in the drawing. The valve 43 is urged downward by a valve spring 44 to bring a conical valve head 45 formed on a top portion of the valve 43 into engagement with a valve seat 46 formed on an upper edge of a control port 52 communicating with the inside of the common rail 5 through a passage 51, thereby blocking fluid communication between the inside of the common rail 5 and a drain port 47 formed in the valve body 41. The passage 51 has a smaller diameter than that of the control port 52 so as to define an orifice. The drain port 47 communicates with the fuel tank 1 at all times.

A solenoid 49 made up of wire wound around a magnetic core 48 is installed on the valve body 41 and turned on and off by a control signal from the ECU 4 similar to the hydraulic control valve 19. The valve 43 has formed thereon an armature 50 made of a magnetic member which is attracted upward against a spring force of the valve spring 44 when the solenoid 49 is turned on. When the armature 50 is attracted to the solenoid 49, it will cause the valve head 45 to be moved out of engagement with the valve seat 46, thereby establishing the fluid communication between the inside of the common rail 5 and the drain port 47 through the control port 52 and the passage 51.

The valve 43 has formed therein a small-diameter cylinder 53 extending vertically. A piston-like balance rod 54 is disposed within the cylinder 53 to define a balance pressure chamber 55 between the bottoms of the balance rod 54 and the cylinder 53. An upper end of the balance rod 54 engages the bottom of the magnetic core 48 at all times. The balance pressure chamber 55 always communicates with the inside of the common rail 5 through a passage 56 formed in the center of the valve 43, the control port 52, and the passage 51.

The pressure control unit 15 operates in a similar manner to that of the hydraulic control valve 19, and explanation thereof in detail will be omitted there.

When the solenoid 49 is turned off, the valve 43, as shown in FIG. 8, engages the valve seat 46 to block the control port 52 so that the fuel is stored within the common rail 5 under a given high pressure.

Here, analyzing a balance of vertical hydraulic pressure acting on the valve 43 and spring force of the valve spring 44, if the diameter of the valve seat 46 (i. e., a portion of the valve head 45 exposed to the control port 52) is defined as ds, and the pressure in the common rail 5 is defined as P, an upward force $F_U$ acting on the valve 43 is given by the following relation:

$$F_U=\pi ds^2P/4$$

If the diameter of the balance rod 54 is defined as $d_R$, and the spring force of the valve spring 44 is defined as Fs, a downward force $F_D$ acting on the valve 43 is given by the following relation:

$$F_D=Fs+\pi d_R^2P/4$$

Therefore, if the diameter ds of the valve seat 46 is 3 mm, and the diameter $d_R$ of the balance rod 54 is 2.95 mm, the upward force $F_U$ is as follows:

$$F_U=7.07\times10^{-2}\times P\ kgf \quad (1)$$

$$F_D=6.83\times10^{-2}\times P+Fs\ kgf \quad (2)$$

From the above equations (1) and (2), a downward force F1 provided by a resultant force of the hydraulic pressure and the spring force of the valve spring 44 acting on the valve 43 in a downward direction is as follows:

$$F1=F_D-F_U=Fs-0.24\times10^{-2}\times P\ kgf \quad (3)$$

Thus, the use of the solenoid 49 designed to produce an attracting force greater than the downward force F1 allows the valve 43 to be moved under control of the ECU 4.

The diameter $d_R$ of the balance rod 54 (i.e., the diameter of the cylinder 53) is set smaller than the diameter ds of the valve seat 46 so that a resultant force of the hydraulic pressures acting on the valve 43 vertically may be slightly oriented upward, apart from the spring force of the valve spring 44 and the attracting force of the solenoid 49. This performs a fail-safe function even ff a failure in pressure control of the common rail 5 occurs so that the pressure in the common rail 5 is undesirably increased due to any abnormality, for example, a malfunction of the pressure sensor 8. Specifically, if a maximum pressure Pmax in the common rail 5 is 1400 kgf/cm$^2$, it is advisable that the spring force Fs of the valve spring 44 be determined so that the downward force F1, as shown below, becomes zero in the above equation (3).

$$F1=Fs-0.24\times10^{-2}\times1400=0$$

Thus, Fs of the valve spring 44 is 3.36 kgf.

Accordingly, if the pressure of fuel stored within the common rail 5 is considerably increased due to some cause so that it reaches the maximum pressure Pmax (e.g., 1400 kfg/cm$^2$), the upward hydraulic force acting on the valve 43 exceeds the spring force of the valve spring 44 bringing the valve head 45 into engagement with the valve seat 46, thereby causing the valve 43 to be moved upward to establish the fluid communication between the inside of the common rail 5 and the drain port 47 so that the pressure of fuel in the common rail 5 is decreased quickly. This prevents the common rail 5 from being broken.

Figure 9:
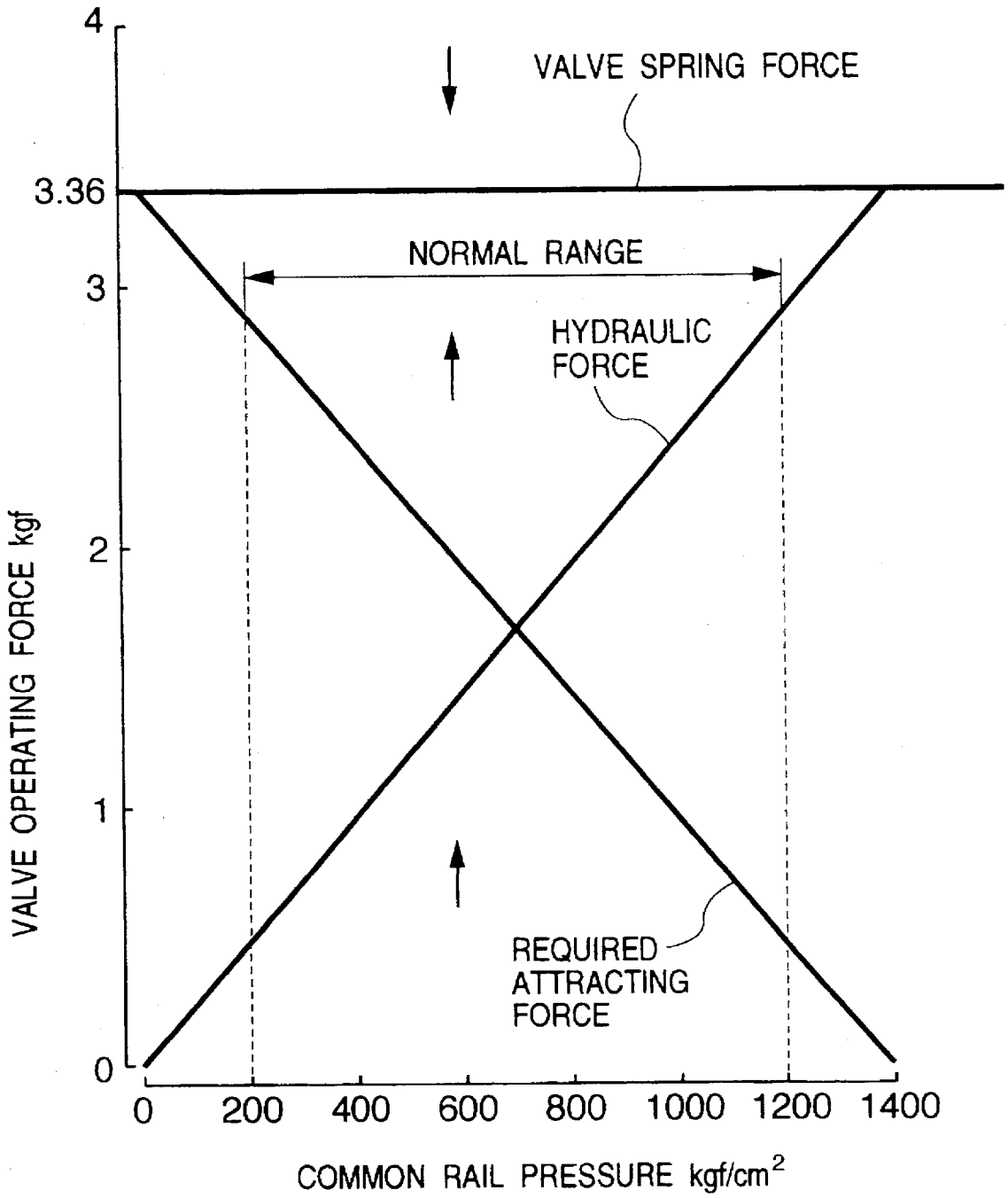
FIG. 9 is a graph which shows the relation between a valve operating force acting on a valve 43 and the pressure of fuel within a common rail 5 in the accumulator fuel injection system as shown in FIG. 6.

FIG. 9 shows the relation between the valve operating force acting on the valve 43 and the pressure of fuel within the common rail 5. Since the spring force Fs of the valve spring 44 acts on the valve 43 downward, and a resultant of hydraulic force and required attracting force of the solenoid 49 acts on the valve 43 upward, the following relation is met.

Required attracting force=Spring force *Fs*−Hydraulic force

Thus, ff the maximum pressure Pmax is 1400 kgf/cm$^2$,

Required attracting force=3.36−3.36=0

If the pressure in the common rail 5 is an upper limit of 1200 kgf/cm$^2$ which is within a normal range, Required attracting force=3.36−2.88=0.48 kgf Alternatively, if the pressure in the common rail 5 is a lower limit of 200 kgf/cm$^2$ which is within the normal range, Required attracting force=3.36−0.48=2.88 kgf It is thus advisable that the required attracting force of the solenoid 49 be 2.88 kgf. This allows the valve 43 to operate normally within the normal range above 200 kgf/cm$^2$.

Conversely, if the pressure in the common rail 5 is at a certain level within a range below the lower limit of 200 kfg/cm$^2$ of the normal range, for example, 100 kgf/cm$^2$, Required attracting force=3.36−0.24=3.12 kgf Specifically, an upward hydraulic force acting on the valve 43 is decreased, and thus the required attracting force of the solenoid 49 becomes greater than that when the pressure in the common rail 5 is 200 kgf/cm$^2$. This causes the valve 43 to remain closed even if the solenoid 49 continues to be turned on when the pressure in the common rail 5 is below the normal range, thereby preventing the engine 6 from being broken, which may be caused by an undesirable drop in pressure in the common rail 5.

As described above, the passage 51 is designed to be smaller in diameter than the control port 52 so as to have the passage 51 function as an orifice. This prevents the fuel pressure of a high level equivalent to the pressure in the common rail 5 from acting on the control port 52 when the valve 43 is moved to the valve-opening position, thereby allowing the valve 43 to be moved at a quick response rate to the valve-closing position even if the valve spring 44 is weak. This also allows the attracting force produced by the solenoid 49 to be decreased for achieving a further reduced size of the solenoid 49. Instead of making the diameter of the passage 51 smaller than that of the control port 52, an orifice may be provided within the passage 51 or the control port 52.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An accumulator fuel injection apparatus comprising:

a first accumulating chamber storing therein fuel under a first pressure;

a fuel injector communicating with the first accumulating chamber;

a control circuit providing a control signal to the fuel injector to inject part of the fuel stored within the first accumulating chamber into an engine;

a second accumulating chamber;

a drain passage communicating the first accumulating chamber with the second accumulating chamber for draining the fuel from the first accumulating chamber to the second accumulating chamber;

valve means for selectively establishing and blocking communication between the first accumulating chamber and the second accumulating chamber; and pressure regulating means for regulating a pressure of the fuel stored within the second accumulating chamber to a second pressure being smaller than the first pressure.

2. An accumulator fuel injection apparatus as set forth in claim 1, wherein when a throttle valve opening degree is controlled to substantially zero during a high-load engine operation, the control circuit provides a control signal to the valve means to establish the communication between the first accumulating chamber and the second accumulating chamber.

3. An accumulator fuel injection apparatus comprising:

a first accumulating chamber storing therein fuel under a first pressure;

a plurality of fuel injectors communicating with the first accumulating chamber for injecting the fuel within the first accumulating chamber into engine cylinders of an engine;

a drain passage for draining the fuel stored with the first accumulating chamber;

a second accumulating chamber disposed within the drain passage; and pressure regulating means for regulating a pressure of the fuel drained through the drain passage to the second accumulating chamber to a second pressure being lower than the first pressure.

4. An accumulator fuel injection apparatus comprising:

a first accumulating chamber storing therein fuel under a first pressure;

a plurality of fuel injectors communicating with the first accumulating chamber for injecting the fuel within the first accumulating chamber into engine cylinders of an engine;

first means for determining whether a given pressure dropping condition for dropping a pressure of the fuel stored within the first accumulating chamber is met, when the given pressure dropping condition is met, the first means provides a release signal;

second means, responsive to the release signal from the first means, for draining the fuel stored within the first accumulating chamber while regulating the pressure thereof to a second pressure being lower than the first pressure; and a drain passage draining the fuel stored within the first accumulating chamber, wherein the second means includes a solenoid valve disposed within the drain passage.

5. An accumulator fuel injection apparatus as set forth in claim 4, wherein the first means includes:

engine speed determining means for determining an engine speed;

throttle valve opening degree determining means for determining an opening degree of a throttle valve; and deceleration determining means for determining whether a given engine operating condition in which the engine decelerates at a given rate when the opening degree of the throttle valve is smaller than a preselected value is met based on the engine speed and the opening degree of the throttle valve determined by the engine speed determining means and the throttle valve opening degree determining means; and when the given engine operating condition is met, the deceleration determining means provides the release signal to the second means.

6. An accumulator fuel injection apparatus as set forth in claim 4, wherein the solenoid valve includes:

a control port having formed thereon a valve seat;

a valve selectively brought into engagement with and disengagement from the valve seat of the control port to open and close the drain passage;

a valve spring urging the valve into engagement with the valve seat of the control port;

a solenoid moving the valve out of the engagement with the valve seat of the control port when the solenoid is turned on;

a cylinder formed in the valve having a diameter smaller than a diameter of the valve seat of the control port;

a balance rod slidably disposed within the cylinder in liquid-tight relationship with the cylinder;

a balance pressure chamber defined within the cylinder by the balance rod; and a passage formed in the valve communicating between the control port and the balance pressure chamber at all times.

7. An accumulator fuel injection apparatus as set forth in claim 6, wherein a spring force of the valve spring is set so that a hydraulic force produced when the fuel is stored within the accumulating chamber under a maximum pressure urges the valve out of the engagement with the valve seat against the spring force of the valve spring.

8. An accumulator fuel injection apparatus as set forth in claim 6, wherein an attracting force of the solenoid moving the valve out of the engagement with the valve seat is so set as to balance with the sum of a hydraulic force acting on the valve, when the fuel is stored in the accumulating chamber under a minimum pressure within a given normal range, and a spring force of the valve spring.

9. An accumulator fuel injection apparatus as set forth in claim 6, further comprising an orifice disposed between the accumulating chamber and the valve seat of the control port.

10. A pressure control apparatus for use in an accumulator fuel injection apparatus including an accumulating chamber storing therein fuel under a given pressure and an electrically controlled fuel injector for injecting the fuel in the accumulating chamber into an engine cylinder, comprising:

a control port having formed thereon a valve seat, communicating with the accumulating chamber through a drain passage for draining the fuel within the accumulating chamber;

a valve selectively brought into engagement with and disengagement from the valve seat of the control port to open and close the drain passage;

a valve spring urging the valve into engagement with the valve seat of the control port;

a solenoid moving the valve out of engagement with the valve seat of the control port when the solenoid is turned on;

a cylinder formed in the valve having a diameter smaller than that of the valve seat of the control port;

a balance rod slidably disposed within the cylinder in liquid-tight relationship therewith;

a balance pressure chamber defined with the cylinder by the balance rod; and a passage formed in the valve communicating between the control port and the balance pressure chamber at all times.

11. A pressure control apparatus as set forth in claim 10, wherein a spring force of the valve spring is set so that hydraulic force produced when the fuel is stored within the accumulating chamber under a maximum pressure urges the valve out of the engagement with the valve seat against the spring force of the valve spring.

12. A pressure control apparatus as set forth in claim 10, wherein an attracting force of the solenoid moving the valve out of the engagement with the valve seat is so set as to balance with a sum of a hydraulic force acting on the valve when the fuel is stored in the accumulating chamber under a minimum pressure within a given normal range and a spring force of the valve spring.

13. A pressure control apparatus as set forth in claim 10, further comprising an orifice communicating between the accumulating chamber and the valve seat of the control port.

14. An accumulator fuel injection apparatus as set forth in claim 3, further comprising:

a solenoid valve disposed within the drain passage, the solenoid valve comprising:

a control port having formed thereon a valve seat, a valve selectively brought into engagement with and disengagement from the valve seat of the control port to open and close the drain passage, a valve spring urging the valve into engagement with the valve seat of the control port, a solenoid moving the valve out of engagement with the valve seat of the control port when the solenoid is turned on, a cylinder formed in the valve having a diameter smaller than a diameter of the valve seat of the control port, a balance rod slidably disposed within the cylinder in liquid-tight relationship with the cylinder, a balance pressure chamber defined within the cylinder by the balance rod, and a passage formed in the valve communicating between the control port and the balance pressure chamber at all times.

15. An accumulator fuel injection apparatus as set forth in claim 14, wherein a spring force of the valve spring is set so that a hydraulic force produced when the fuel is stored within the accumulating chamber under a maximum pressure urges the valve out of the engagement with the valve seat against the spring force of the valve spring.

16. An accumulator fuel injection apparatus as set forth in claim 14, wherein an attracting force of the solenoid moving the valve out of the engagement with the valve seat is so set as to balance with the sum of a hydraulic force acting on the valve, when the fuel is stored in the accumulating chamber under a minimum pressure within a given normal range, and a spring force of the valve spring.

17. An accumulator fuel injection apparatus as set forth in claim 14, further comprising an orifice disposed between the accumulating chamber and the valve seat of the control port.

18. An accumulator fuel injection apparatus comprising:

a first accumulating chamber storing therein fuel under a first pressure;

a fuel injector communicating with the first accumulating chamber;

a control circuit providing a control signal to the fuel injector to inject part of the fuel stored within the first accumulating chamber into an engine;

a second accumulating chamber;

a drain passage communicating the first accumulating chamber with the second accumulating chamber for draining the fuel from the first accumulating chamber to the second accumulating chamber;

a valve to selectively establish and block communication between the first accumulating chamber and the second accumulating chamber; and a pressure regulator to regulate a pressure of the fuel stored within the second accumulating chamber to a second pressure being smaller than the first pressure.

19. An accumulator fuel injection apparatus as set forth in claim 18, wherein when a throttle valve opening degree is controlled to substantially zero during a high-load engine operation, the control circuit provides a control signal to the valve means to establish the communication between the first accumulating chamber and the second accumulating chamber.

* * * * *